US010340057B2

(12) United States Patent
Spiel

(10) Patent No.: US 10,340,057 B2
(45) Date of Patent: Jul. 2, 2019

(54) UNIFIED POWER AND DATA CABLE

(71) Applicant: Cisco Technology, Inc., San Jose, CA (US)

(72) Inventor: Seth Brandon Spiel, San Francisco, CA (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 14/950,757

(22) Filed: Nov. 24, 2015

(65) Prior Publication Data

US 2017/0149406 A1 May 25, 2017

(51) Int. Cl.

| | |
|---|---|
| ***H01B 7/18*** | (2006.01) |
| ***H01B 9/00*** | (2006.01) |
| *H01B 9/04* | (2006.01) |
| *H01B 11/00* | (2006.01) |

(52) U.S. Cl.

CPC ..... *H01B 9/003* (2013.01); *H01B 9/04* (2013.01); *H01B 11/00* (2013.01)

(58) Field of Classification Search

CPC ..... H01B 7/1875
USPC ..... 174/105 R, 113 C
See application file for complete search history.

(56) References Cited

U.S. PATENT DOCUMENTS 1,940,917 A * 12/1933 Okazaki ..... H01B 7/1895 174/113 C
2,376,101 A * 5/1945 Tyzzer ..... H01B 9/04 174/105 R
2,769,149 A * 10/1956 Kreer, Jr. ..... H01P 3/06 156/53
3,484,679 A * 12/1969 Hodgson ..... H01B 9/04 174/105 R
3,831,636 A * 8/1974 Bittner ..... H01B 7/226 138/112
4,510,346 A * 4/1985 Bursh, Jr. ..... H01B 11/1016 174/106 R
4,841,845 A 6/1989 Beullens
5,321,202 A * 6/1994 Hillburn ..... H01B 11/1826 156/54
5,493,070 A * 2/1996 Habu ..... H01B 11/206 174/102 R
6,563,052 B2 * 5/2003 Groegl ..... H01B 11/1041 174/106 R (Continued)

*Primary Examiner* — Chau N Nguyen
(74) *Attorney, Agent, or Firm* — Polsinelli PC

(57) ABSTRACT

In one embodiment, a cable includes a data transmission path disposed about an axial center of the cable and a power transmission path sheathing the data transmission path. The power transmission path includes a power layer and a ground layer, where the power transmission path is characterized by a distributed impedance having at least one frequency dependent impedance characteristic. In some implementations, ground layer shields the data transmission path from electromagnetic interference. In some implementations, the frequency dependent impedance characteristic of the power transmission path is characterized by a capacitance value that satisfies a capacitance criterion at frequencies above a first frequency level. In some implementations, the frequency dependent impedance characteristic of the power transmission path is characterized by an inductance value that satisfies a first inductance criterion at frequencies above a first frequency level.

13 Claims, 9 Drawing Sheets

(56) References Cited

U.S. PATENT DOCUMENTS

| | | | | |
|---|---|---|---|---|
| 7,105,739 | B2 * | 9/2006 | Abe | H01B 11/1813 174/102 R |
| 7,485,811 | B2 * | 2/2009 | Mjelstad | H01B 7/045 174/113 C |
| 7,591,673 | B2 | 9/2009 | Chan et al. | |
| 7,919,713 | B2 * | 4/2011 | Al-Ali | A61B 5/14551 174/113 R |
| 8,080,734 | B2 * | 12/2011 | Mukai | H01Q 9/30 174/102 R |
| 8,230,115 | B2 | 7/2012 | Lee | |
| 8,487,184 | B2 * | 7/2013 | Rivernider, Jr. | H01B 11/1033 174/102 R |
| 2004/0200631 | A1 | 10/2004 | Chen | |
| 2007/0253177 | A1 * | 11/2007 | Nibe | H05K 1/0231 361/763 |
| 2014/0168917 | A1 * | 6/2014 | Marzano | A61N 1/3754 361/752 |
| 2016/0070313 | A1 * | 3/2016 | Wu | G06K 19/07732 361/679.32 |

* cited by examiner

UNIFIED POWER AND DATA CABLE

TECHNICAL FIELD

The present disclosure relates generally to managing connectivity of networking equipment, and in particular, to cables configured to handle both power and data transmission.

BACKGROUND

The ongoing development and expansion of data networks often involves balancing scalability and modularity of networking equipment against ease of connectivity and preferable form factors. For example, for larger-scale enterprise infrastructure deployments, a number of network switches are often incorporated into a single network switching chassis that has a relatively compact form factor and reduces the number of cables between the network switches by using a shared backplane. However, deployment of a network switching chassis often involves a significant upfront capital expense. Moreover, a network switching chassis provides a relatively large amount of functional capacity that may not be fully utilized for a particular deployment, even if demand is projected to grow.

For smaller and more scalable deployment demands, a number of network switches are often connected in a stacked arrangement. The stacked arrangement provides enhanced scalability and modularity as compared to the aforementioned single network switching chassis. The stacked arrangement often involves a smaller upfront capital expense, and allows capital expenses to be distributed over time in response to demand for network growth. However, there are a number of problems with the stacked arrangement. As the stacked arrangement grows, separate data stacking cables are used to enable high speed switching of packet traffic between network switches. Furthermore, separate power stacking cables are used to enable high power redundancy between network switches. A stacked arrangement with four network switches, for example, uses four data stacking cables and four power stacking cables to connect the network switches in a ring topology.

The separate data stacking and power stacking cables are both expensive and cumbersome. Furthermore, the number of cables used to connect the network switches in a stacked arrangement leads to installation errors, which, in turn, causes degradation of network up-time and performance.

BRIEF DESCRIPTION OF THE DRAWINGS

So that the present disclosure can be understood by those of ordinary skill in the art, a more detailed description may be had by reference to aspects of some illustrative implementations, some of which are shown in the accompanying drawings.

Figure 1:
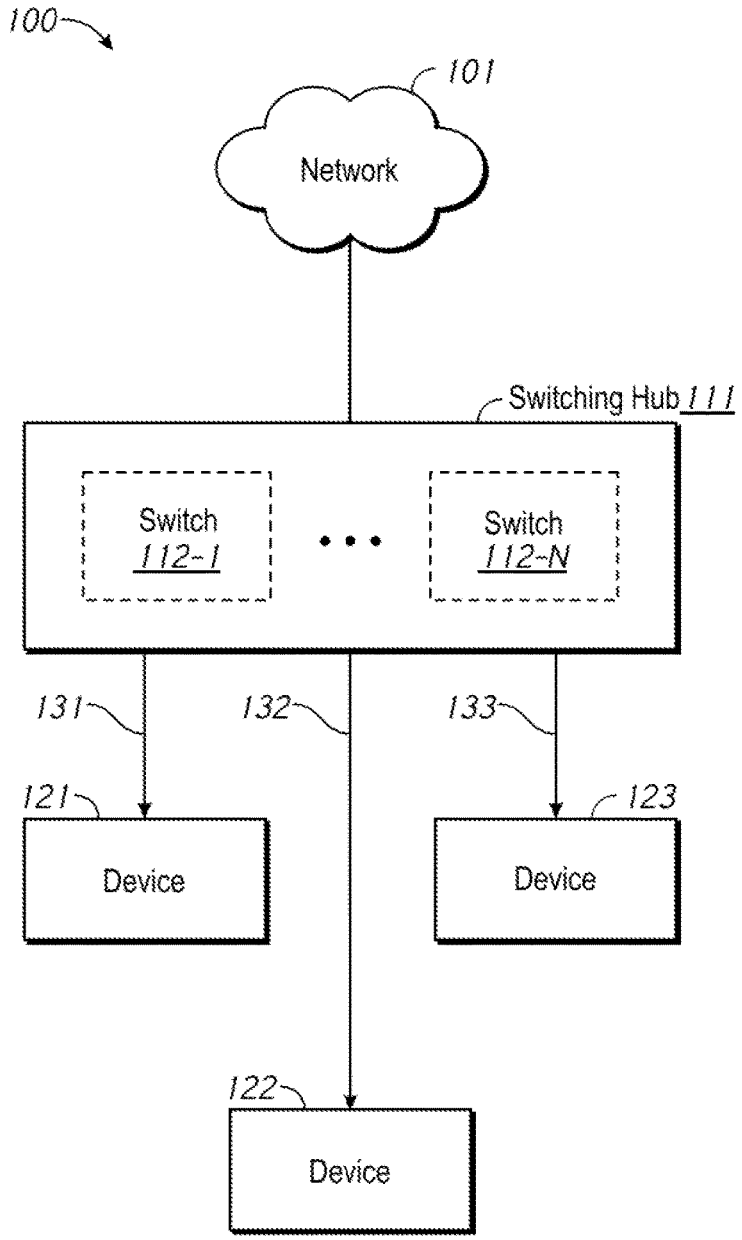
FIG. 1 is a block diagram of a data network in accordance with some implementations.

In accordance with common practice various features shown in the drawings may not be drawn to scale, as the dimensions of various features may be arbitrarily expanded or reduced for clarity. Moreover, the drawings may not depict all of the aspects and/or variants of a given system, method or apparatus admitted by the specification. Finally, like reference numerals are used to denote like features throughout the figures.

DESCRIPTION OF EXAMPLE EMBODIMENTS

Numerous details are described herein in order to provide a thorough understanding of the illustrative implementations shown in the accompanying drawings. However, the accompanying drawings merely show some example aspects of the present disclosure and are therefore not to be considered limiting. Those of ordinary skill in the art will appreciate from the present disclosure that other effective aspects and/or variants do not include all of the specific details of the example implementations described herein. While pertinent features are shown and described, those of ordinary skill in the art will appreciate from the present disclosure that various other features, including well-known systems, methods, components, devices, and circuits, have not been illustrated or described in exhaustive detail for the sake of brevity and so as not to obscure more pertinent aspects of the example implementations disclosed herein.

Overview

Various implementations disclosed herein include methods, devices, apparatuses, and systems for enabling power and data transmission between two or more devices with a unified power and data cable. For example, in some implementations, a cable includes a data transmission path disposed about an axial center of the cable and a power transmission path sheathing the data transmission path. The power transmission path includes a power layer and a ground layer, where the power transmission path is characterized by a distributed impedance having at least one frequency dependent impedance characteristic.

Example Embodiments

Figure 2:
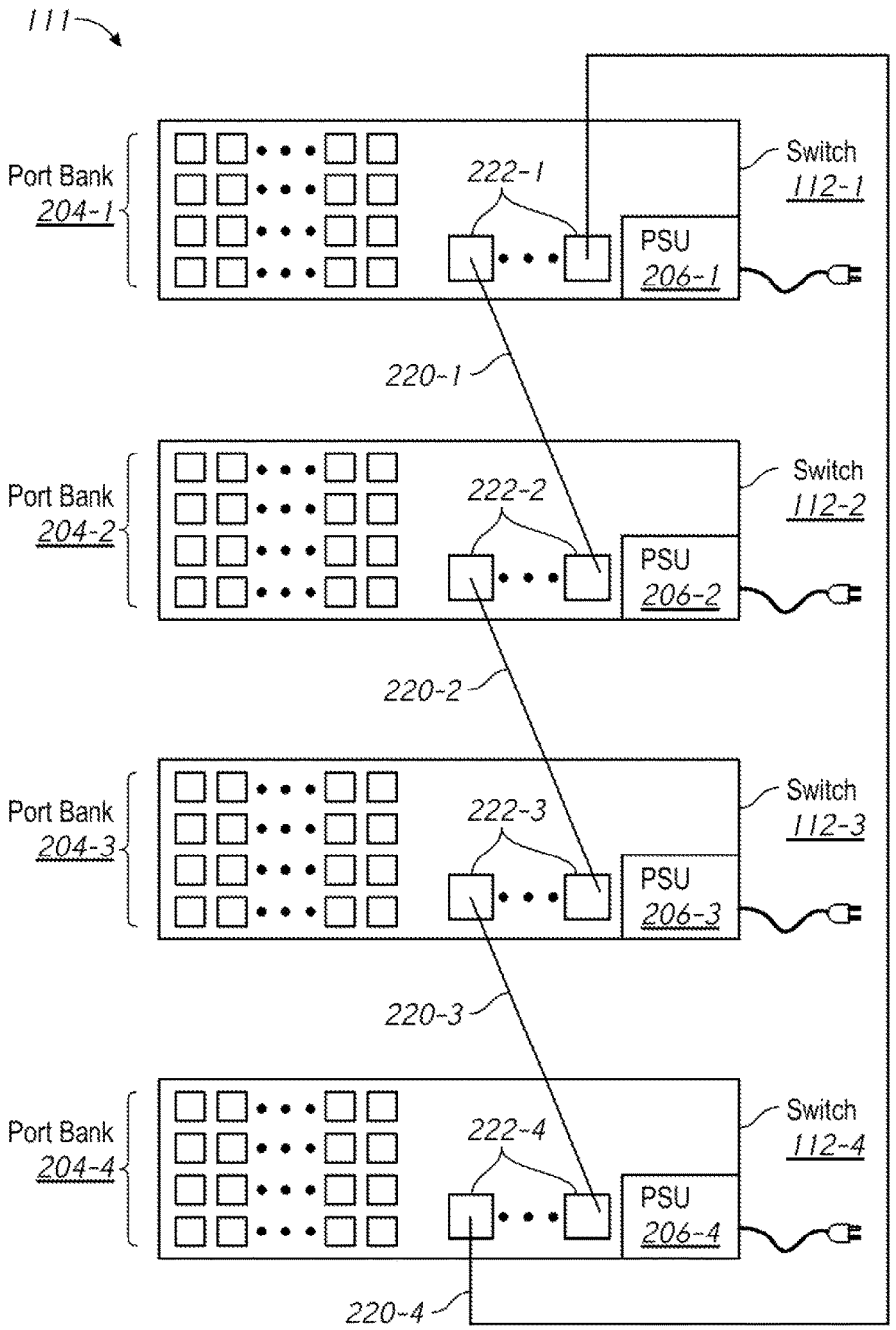
FIG. 2 is a block diagram of an interconnected stack of switches in accordance with some implementations.

In some implementations, a plurality of network switches are provided in a stacked arrangement (e.g., as shown in FIG. 2). The plurality of network switches are connected according to various topologies (e.g., ring, star, mesh, etc.) with unified power and data cables. A unified power and data cable includes both a data transmission path provided to support high frequency packet traffic between two network devices and a power transmission path provided to support power connection redundancy between the same two network devices, which sheathes the data transmission path. The use of unified power and data cables not only reduces infrastructure costs related to the stacked arrangement but also reduces the potential for human error during installation because a lesser number of cables are used. Additionally, combining the power and data into a single cable prevents the operator from splitting power and data redundancy. When power and redundancy are split, additional unrecoverable failures modes are introduced, which contradicts the purpose of redundant stacking.

In a stacked arrangement of network switches (or other network devices), the respective ports of one switch are coupled to adjacent switches in the stack in order to form a chained data path or data path ring using unified power and data cables. Similarly, the respective power port of one switch is coupled to adjacent switches in the stack in order to form a chained power path or power path ring using the same unified power and data cables. In such an arrangement, if a first network switch fails, power and data is re-routed through adjacent switches in the stack so that the stack as a whole merely operates at reduced capacity and does not fail altogether. Electromagnetic interference (e.g., a noise spike) is produced by the instantaneous change in current when the adjacent network switches deliver power to the failed, first network switch over the power transmission paths of the unified power and data cables. In some implementations, a ground layer of the power transmission path is located between the power transmission path and the data transmission path of the unified power and data cable to shield packet traffic on the data transmission path from the aforementioned electromagnetic interference.

FIG. 1 is a block diagram of a data network 100 in accordance with some implementations. The data network 100 includes an interconnected stack of switches 111 (sometimes also herein called a "switching hub") that couples a number of devices 121-123 to a network 101. The network 101 may include any public or private LAN (local area network) and/or WAN (wide area network), such as an intranet, an extranet, a virtual private network, and/or portions of the Internet. In some implementations, one or more of the devices 121-123 are client devices including hardware and software for performing one or more functions. Example client devices include, without limitation, network routers, switches, wireless access points, IP (Internet protocol) cameras, VoIP (voice over IP) phones, intercoms and public address systems, clocks, sensors, access controllers (e.g., keycard readers), lighting controllers, etc. In some implementations, one or more of the devices 121-123 are virtual devices that consume power through the use of underlying hardware.

The interconnected stack of switches 111 (which may also be referred to as a switching hub, a network switch, a bridging hub, a MAC (media access control) bridge, or a combination of multiple components thereof) receives and transmits data between the network 101 and the devices 121-123. In some implementations, the interconnected stack of switches 111 manages the flow of data of the data network 100 by transmitting messages received from the network 101 to the devices 121-123 for which the messages are intended. In some implementations, each of the devices 121-123 coupled to the interconnected stack of switches 111 is identified by a MAC address, allowing the interconnected stack of switches 111 to regulate the flow of traffic through the data network 100 and also to increase the security and efficiency of the data network 100. In some implementations, the interconnected stack of switches 111 includes a plurality of network switches 112-1, . . . , 112-N each of which are coupled to one or more of the devices 121-123.

The interconnected stack of switches 111 is communicatively coupled to each of the devices 121-123 via respective transmission media 131-133, which may be wired or wireless. In some implementations, the interconnected stack of switches 111, in addition to receiving and transmitting data via the transmission media 131-133, provides power to the devices 121-123 via the transmission media 131-133. For example, in some implementations, the interconnected stack of switches 111 is coupled to the devices 121-123 via an Ethernet cable.

In some implementations, the interconnected stack of switches 111 or component(s) thereof (e.g., network switches 112-1, . . . , 112-N) provide power to the devices 121-123 via an Ethernet cable according to a Power-over-Ethernet (PoE) standard. For example, the interconnected stack of switches 111 provides power to the devices 121-123 according to the Institute of Electrical and Electronics Engineers (IEEE) 802.3af standard. Continuing with this example, the interconnected stack of switches 111 outputs 15.4 W (watts) of power to each of the devices 121-123. In other examples, the interconnected stack of switches 111 provides power to the devices 121-123 according to other standards such as IEEE 802.3at, IEEE 802.3az, IEEE 802.3bt, or the like. In some implementations, the interconnected stack of switches 111 or component(s) thereof (e.g., network switches 112-1, . . . , 112-N) provide power to the devices 121-123 via other types of transmission media 131-133 such as a Universal Serial Bus (USB) cable or the like.

FIG. 2 is a block diagram of the interconnected stack of switches 111 in accordance with some implementations. For ease of discussion, the interconnected stack of switches 111 in FIG. 2 comprises network switches 112-1, 112-2, 112-3, and 112-4 implemented in a stacked arrangement. In some implementations, one of ordinary skill in the art will appreciate that the interconnected stack of switches 111 comprises an arbitrary number of network switches or similar network devices. In some implementations, each of the network switches 112 includes: a port bank 204; two or more inter-switch ports 222; and a power supply unit (PSU) 206.

Port bank 204-1 of representative network switch 112-1 includes a plurality of ports (e.g., 24, 48, etc.) for connecting the network switch 112-1 with one or more of the devices 121-123. For example, the network switch 112-1 is coupled with one or more of the devices 121-123 via Ethernet cables connected to the ports of the port bank 204-1 (not shown). In some implementations, all of the ports of the port bank 204-1 are alike (e.g., Ethernet ports). In some implementations, the port bank 204-1 includes at least two types of ports (e.g., both Ethernet and USB ports).

In some implementations, the network switches 112 are interconnected in a ring topology, as shown in FIG. 2, using unified power and data cables 220-1, 220-2, 220-3, and 220-4. In some implementations, one of ordinary skill in the art will appreciate that the network switches 112 are coupled according to various other topologies, such as a star topology or a mesh/fully-connected topology, using a same or a different number of unified power and data cables. For example, the network switch 112-1 is coupled to network switch 112-2 via cable 220-1, which is connected to one of inter-switch ports 222-1, and also to network switch 112-4 via cable 220-4, which is connected to a different one of inter-switch ports 222-1. In this example, the cable 220-1 has a first connector (not shown) terminating a first end of the cable 220-1 that is connected to one of inter-switch ports 222-1 of the network switch 112-1 and a second connector (not shown) terminating a second end of the cable 220-1 that is connected to one of inter-switch ports 222-2 of the network switch 112-2.

In some implementations, the cables 220 are unified power and data cables that enable high frequency packet traffic between network switches 112 and also enable redundant power between networks switches 112. For example, if PSU 206-1 of the network switch 112-1 fails, the network switch 112-1 sinks power from network switch 112-2 via the cable 220-1 and/or from network switch 112-4 via the cable 220-4. Furthermore, network switches 112-2 and 112-4 route data traffic to the network switch 112-1 via cables 220-1 and 220-4, respectively.

In one example, if 48 devices are connected to the 48 ports of port bank 204-1 of the network switch 112-1 and all of the devices are sourcing power from the network switch 112-1 according to IEEE 802.3at (e.g., approximately 30 W each), at least one of the network switch 112-2 and the network switch 112-4 provides a total power supply boost of approximately 1.5 kW to the devices connected to the port bank 204-1 when the network switch 112-1 fails.

In some implementations, PSUs 206 operate at a switching frequency between 500 kHz and 5 MHz. In those implementations, the network switches 112-2 and 112-4 are limited to delivering power at these speeds, leaving a power supply gap between the failure of the network switch 112-1 and a subsequent power boost from network switches 112-2 and/or 112-4 according to the switching frequency of PSUs 206-2 and 206-4, respectively. To account for this power supply gap, at least a portion of each of the cables 220 act as a distributed capacitance path that store charge to supply current to a failed network switch and/or the device connected to the failed network switch during the power supply gap.

Figure 3:
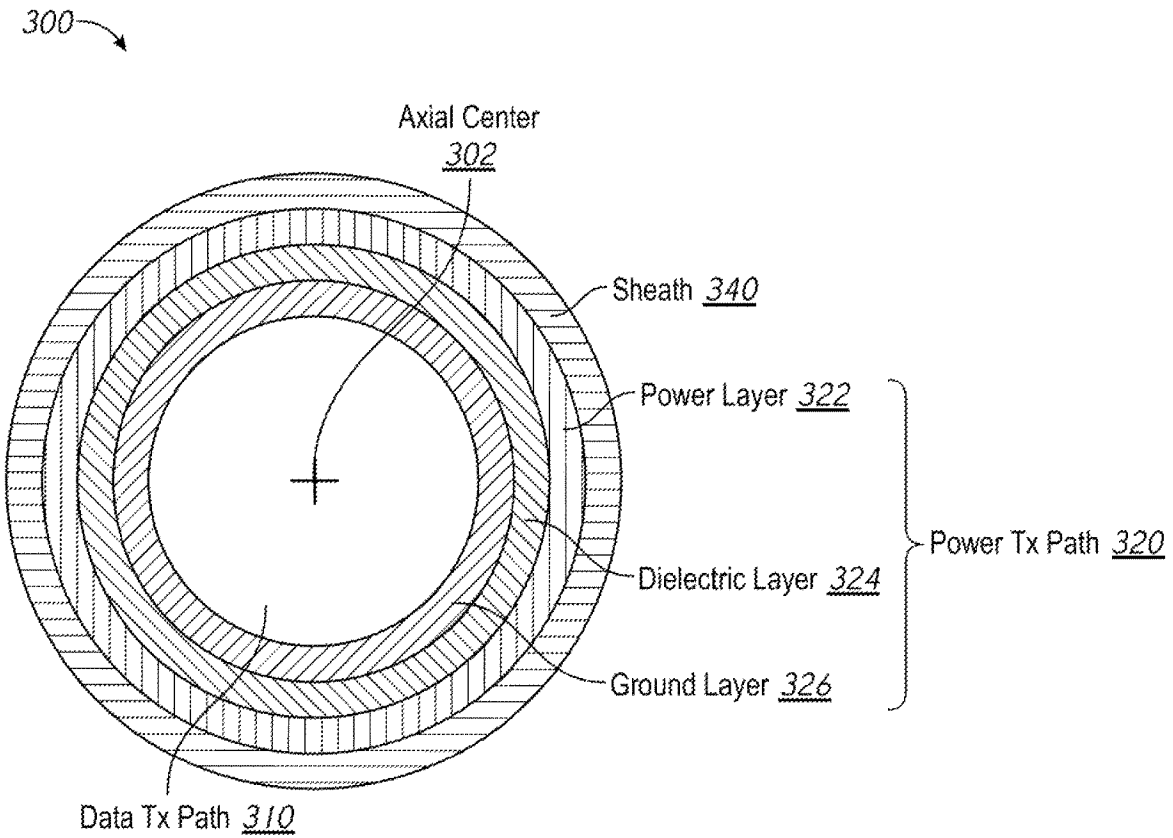
FIG. 3 is a cross-section view of a unified power and data cable in accordance with some implementations.

FIG. 3 is a cross-section view of a unified power and data cable 300 in accordance with some implementations. For example, the unified power and data cable 300 is one of the cables 220 in FIG. 2. In some implementations, the unified power and data cable 300 comprises: a data transmission path 310 centered on an axial center 302 of the unified power and data cable 300; a power transmission path 320 that sheathes the data transmission path 310; and a sheath 340 that sheathes the power transmission path 320. In some implementations, the power transmission path 320 comprises: a power layer 322; a dielectric layer 324; and a ground layer 326.

In some implementations, the data transmission path 310 includes one or more data lines that extend along the longitudinal axis of the unified power and data cable 300. The power transmission path 320 and the sheath 340 are radially disposed about the axial center 302 so that the unified power and data cable 300 is a cylindrical cable. In other implementations, the unified power and data cable 300 is an elliptical cylinder.

The power transmission path 320 forms a distributed impedance path that extends along the longitudinal axis of the unified power and data cable 300. As such, the transmission path 320 stores charge so as to supply current during the power supply gap between when a network switch fails and the PSU of a connected network switch provides a power boost according to the PSU's switching frequency.

With reference to the power transmission path 320, the dielectric layer 324 is located between the power layer 322 and the ground layer 326. In some implementations, the dielectric layer 324 comprises one or more materials such as aluminum oxide, polyethylene (PE), polytetrafluoroethylene (PTFE), and/or the like. The capacitance value for the unified power and data cable 300 corresponds to the equation, $$C = \frac{(\varepsilon_0 \times \varepsilon_r \times A)}{d},$$

where A is the area of the power layer 322 and the ground layer 326, $\varepsilon_0$ is the permittivity of a vacuum (e.g., a constant), $\varepsilon_r$ is the relative permittivity of the dielectric material comprising the dielectric layer 324, and d is the gap between the conductor and ground plane (e.g., the thickness of the dielectric layer 324).

The thickness and material of the dielectric layer 324 are selected to satisfy one or more capacitance criteria (e.g., a threshold capacitance value at one or more predefined frequencies), within a predefined tolerance range. For example, the dielectric material is selected such that its relative permittivity meets a predetermined permittivity threshold and the thickness is selected such that it is less than a predetermined thickness threshold. As such, the thickness and material of the dielectric layer 324 are selected so that the capacitance of the unified power and data cable 300 is at least a threshold value at one or more predefined frequencies.

In some implementations, the power layer 322 comprises a solid conductor such as copper, aluminum, steel, a metallic composite, or the like. In other implementations, the power layer 322 comprises woven conductive fibers such as copper, aluminum, steel, metallic composite, or the like. The woven conductive fibers reduce the skin depth effect at high frequencies and also lend physical flexibility to the unified power and data cable 300. Physical flexibility is important if the cable needs to be wrapped or maintain a maximum threshold bend radius. In some implementations, the diameter of the conductive fibers of the power layer 322 is selected based on a predefined frequency or range of frequencies (e.g., the switching frequency of the PSUs 206 of the network switches 112 in FIG. 2) to reduce the skin depth effect at the predefined frequency or range of frequencies. In some implementations, the ground layer 326 comprises a solid conductor such as copper, aluminum, steel, metallic composite, or the like. In other implementations, the ground layer 326 comprises woven conductive fibers such as copper, go aluminum, steel, a metallic composite, or the like.

With reference to FIG. 3, the power layer 322 is radially disposed a first distance from the axial center 302, and the ground layer 326 is radially disposed a second distance from the axial center 302, where the second distance from the axial center 302 is less than the first distance. As such, the ground layer 326 shields the data transmission path 310 from electromagnetic interference caused by the power layer 322. In other implementations, the power layer 322 is radially disposed a first distance from the axial center 302, and the ground layer 326 is radially disposed a second distance from the axial center 302, where the second distance from the axial center 302 is greater than the first distance.

In some implementations, the power layer 322 acts as a current source path from a power source (e.g., a network switch providing power redundancy to a failed network switch and/or the device(s) connected to the failed network switch) to a load (e.g., the failed network switch and/or the device(s) connected to the failed network switch), and the ground layer 326 acts as a current return path from the load to the power source. In some implementations, the ground layer 326 also acts as a return path for the one or more data lines of the data transmission path 310.

In some implementations, the power transmission path 320 is a distributed impedance path with at least one frequency dependent impedance characteristic. In some implementations, the frequency dependent impedance characteristic of the power transmission path 320 is characterized by a capacitance value that satisfies a capacitance criterion at frequencies above (or below) a first frequency level. For example, when a high frequency event at frequencies above a first frequency level occurs (e.g., frequencies greater than 100 MHz), such as powering on a network switch or delivering power to a failed/disabled network switch, the capacitance value of the power transmission path 320 is greater than a threshold capacitance value (e.g., between 1 nF and 100 nF).

In some implementations, the frequency dependent impedance characteristic of the power transmission path 320 is characterized by an inductance value that satisfies a first inductance criterion at frequencies above a first frequency level. For example, when a high frequency event at frequencies above a first frequency level occurs (e.g., frequencies greater than 100 MHz), such as powering on a network switch or delivering power to a failed/disabled network switch, the inductance value of the power transmission path 320 at a particular frequency or frequencies is less than a threshold inductance value (e.g., 10 nH).

In some implementations, the frequency dependent impedance characteristic of the power transmission path 320 is characterized by an inductance value that satisfies a second inductance criterion at frequencies below a second frequency level. For example, at frequencies lower than 60 Hz, such as direct current (DC) operation, the inductance value of the power transmission path 320 is less than a threshold inductance value (e.g., 10 nH).

The sheath 340 insulates the data transmission path 310 and the power transmission path 320 and also protects the unified power and data cable 300 from abrasions. In some implementations, the sheath 340 comprises one or more materials such as polyvinyl chloride (PVC), polyethylene (PE), chlorinated polyethylene (CPE), thermoplastic elastomer (TPE), nylon, cross-linked polyethylene (XLPE), polychloroprene (PCP), chlorosulfonated polyethylene (CSPE), ethylene propylene rubber (EPR), and/or the like.

Figure 4A:
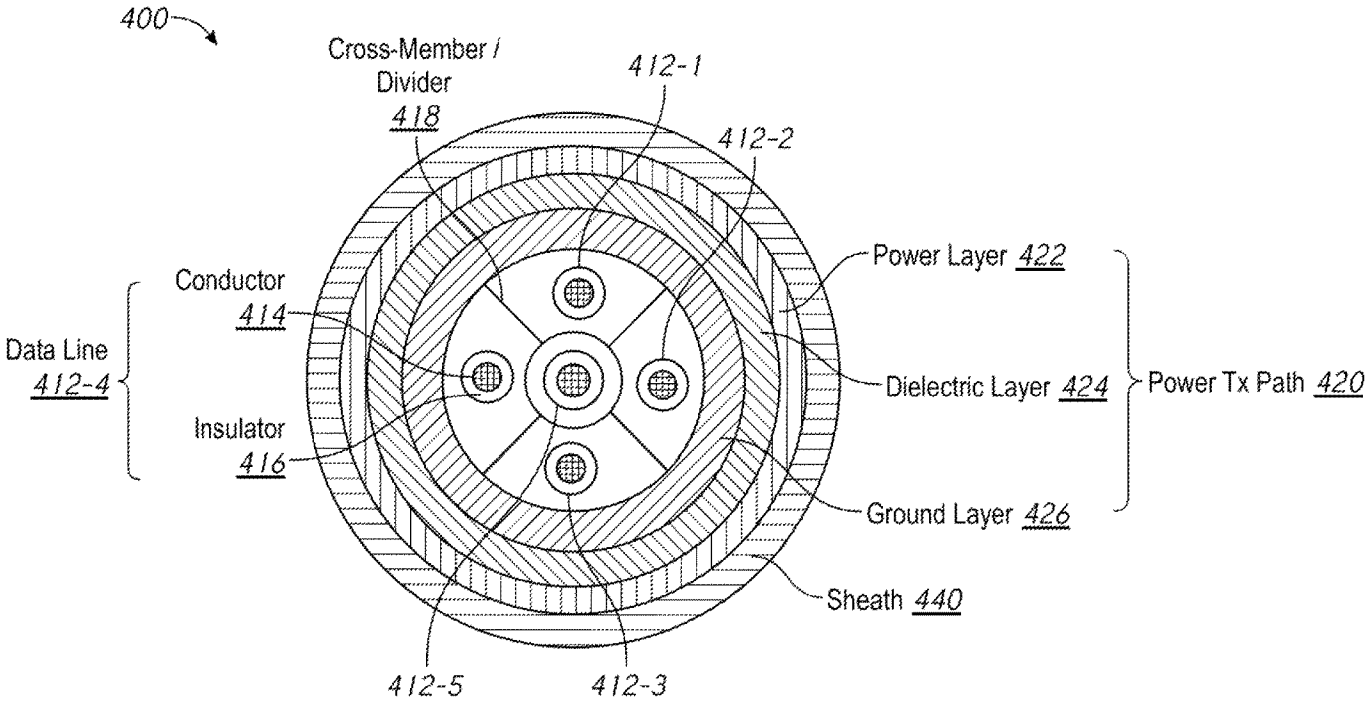
FIG. 4A is a cross-section view of a unified power and data cable in accordance with some implementations.

FIG. 4A is a cross-section view of a unified power and data cable 400 in accordance with some implementations. For example, the unified power and data cable 400 is one of the cables 220 in FIG. 2. In some implementations, the unified power and data cable 400 comprises: a data transmission path with a plurality of data lines 412; a power transmission path 420 that sheathes the data transmission path; and a sheath 440 that sheathes the power transmission path 420.

In FIG. 4A, the data transmission path includes data lines 412-1, 412-2, 412-3, 412-4, and 412-5 that extend along the longitudinal axis of the unified power and data cable 400. In some implementations, one of ordinary skill in the art will appreciate that the data transmission path comprises an arbitrary number of data lines. Representative data line 412-4 includes a conductor 414 that is sheathed by an insulator 416. In some implementations, the data lines 412 are differential pairs, twisted pairs, or the like. In some implementations, the data transmission path also includes a cross-member/divider 418 to shield and separate the plurality of data lines 412 as shown in FIG. 4A. In some implementations, the number of compartments forming and the geometry of the cross-member/divider 418 are determined by the number of data lines 412 in the data transmission path.

Similar to the power transmission path 320 in FIG. 3, the power transmission path 420 comprises: a power layer 422; a dielectric layer 424; and a ground layer 426. According to some implementations, the aforementioned components of the power transmission path 420 be adapted from those discussed above with reference to the power transmission path 320 in FIG. 3 and are not described again in detail for the sake of brevity.

Figure 4B:
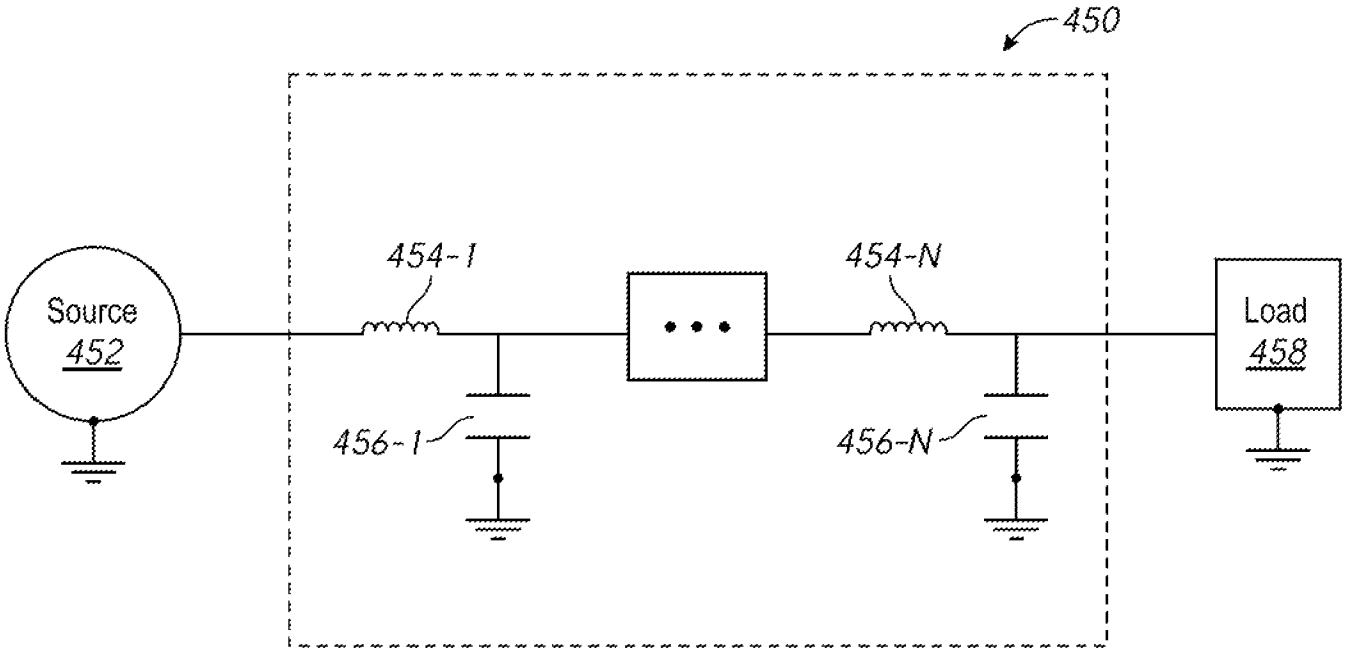
FIG. 4B is a schematic diagram of a single power transmission line with parasitics in accordance with some implementations.

FIG. 4B is a schematic diagram of a single power transmission line with parasitics corresponding to the unified power and data cable 400 in FIG. 4A in accordance with some implementations. In FIG. 4B, the source 452 (e.g., one of network switches 112 in FIG. 2) delivers power to a load 458 (e.g., a failed on of the network switches 112 in FIG. 2 and/or devices connected thereto) via the unified power and data cable 400 shown in FIG. 4A. In accordance with some implementations, the unified power and data cable 400 is modeled as block 450 of the schematic in FIG. 4B, which includes a plurality of inductors 454-1, . . . , 454-N and a plurality of capacitors 456-1, . . . , 456-N.

Figure 5A:
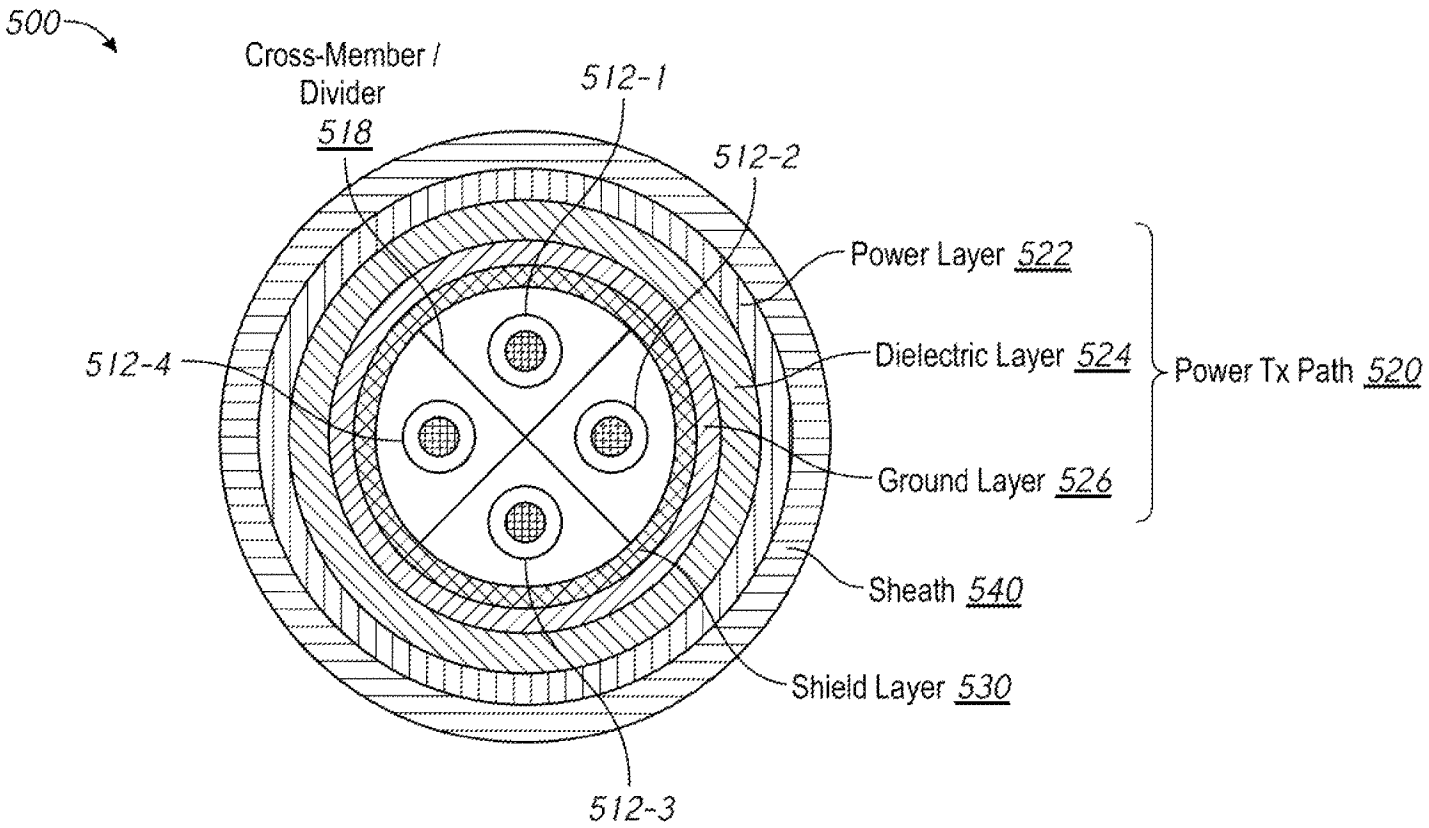
FIG. 5A is another cross-section view of a unified power and data cable in accordance with some implementations.
Figure 5B:
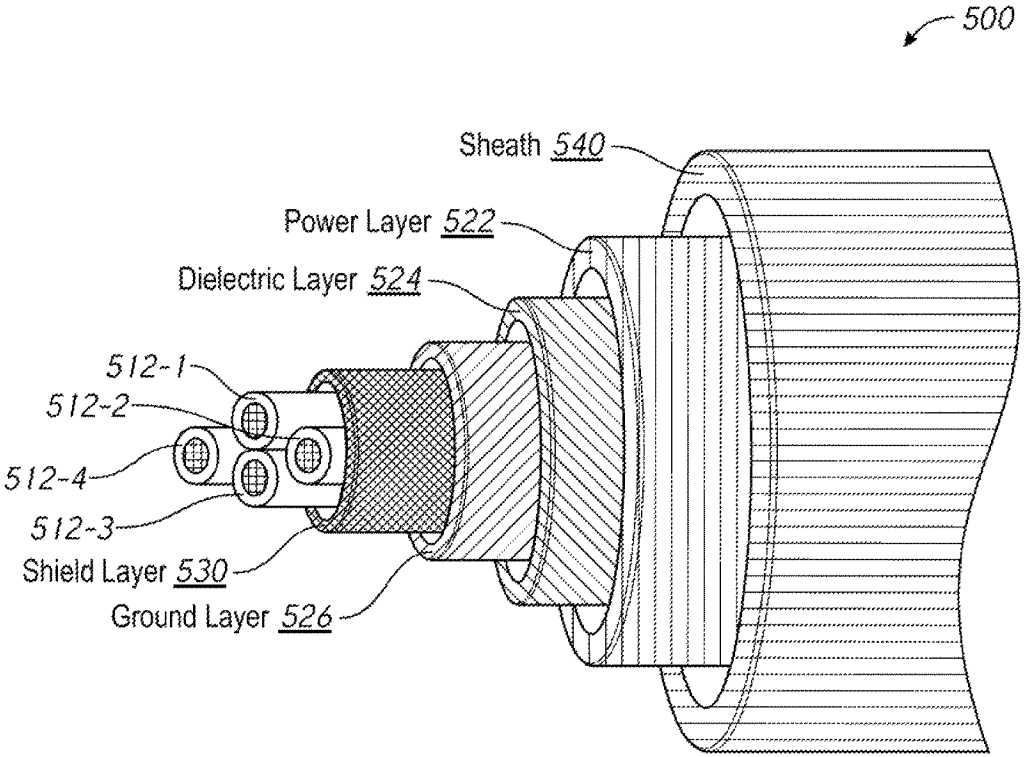
FIG. 5B is a cut-away view of the unified power and data cable in FIG. 5A in accordance with some implementations.

FIG. 5A is another cross-section view of a unified power and data cable 500 in accordance with some implementations. FIG. 5B is a cut-away view of the unified power and data cable 500 in FIG. 5A in accordance with some implementations. For example, the unified power and data cable 500 is one of the cables 220 in FIG. 2. In some implementations, the unified power and data cable 500 comprises: a data transmission path with a plurality of data lines 512; a power transmission path 520 that sheathes the data transmission path; a shield layer 530 located between the data transmission path and the power transmission path 520; and a sheath 540 that sheathes the power transmission path 520.

In some implementations, the shield layer 530 shields the data transmission path from electromagnetic interference caused by the power transmission path 520—more specifically power layer 522. In some implementations, there is a dielectric layer (not shown) between the shield layer 530 and the ground layer 526 of the power transmission path 520. In some implementations, the shield layer 530 is isolated from the power transmission path 520. In some implementations, the shield layer 530 is singly or doubly grounded. In some implementations, the shield layer 530 comprises an insulator. In some implementations, the shield layer 530 comprises an insulated conductor such as copper, aluminum, steel, a metallic composite, or the like. In other implementations, the shield layer 530 comprises an insulated mesh conductor or woven conductive fibers such as copper, aluminum, steel, a metallic composite, or the like.

In FIG. 5A, the data transmission path includes data lines 512-1, 512-2, 512-3, and 512-4 that extend along the longitudinal axis of the unified power and data cable 500. In some implementations, one of ordinary skill in the art will appreciate that the data transmission path comprises an arbitrary number of data lines. In some implementations, the data transmission path also includes a cross-member/divider 518 to shield and separate the plurality of data lines 512 as shown in FIG. 5A. In some implementations, the number of compartments forming and the geometry of the cross-member/divider 518 are determined by the number of data lines 512 in the data transmission path.

Similar to the power transmission path 320 in FIG. 3, the power transmission path 520 comprises: a power layer 522; a dielectric layer 524; and a ground layer 526. In some implementations, the aforementioned components of the power transmission path 520 are adapted from those discussed above with reference to the power transmission path 320 in FIG. 3 and are not described again in detail for the sake of brevity.

Figure 6A:
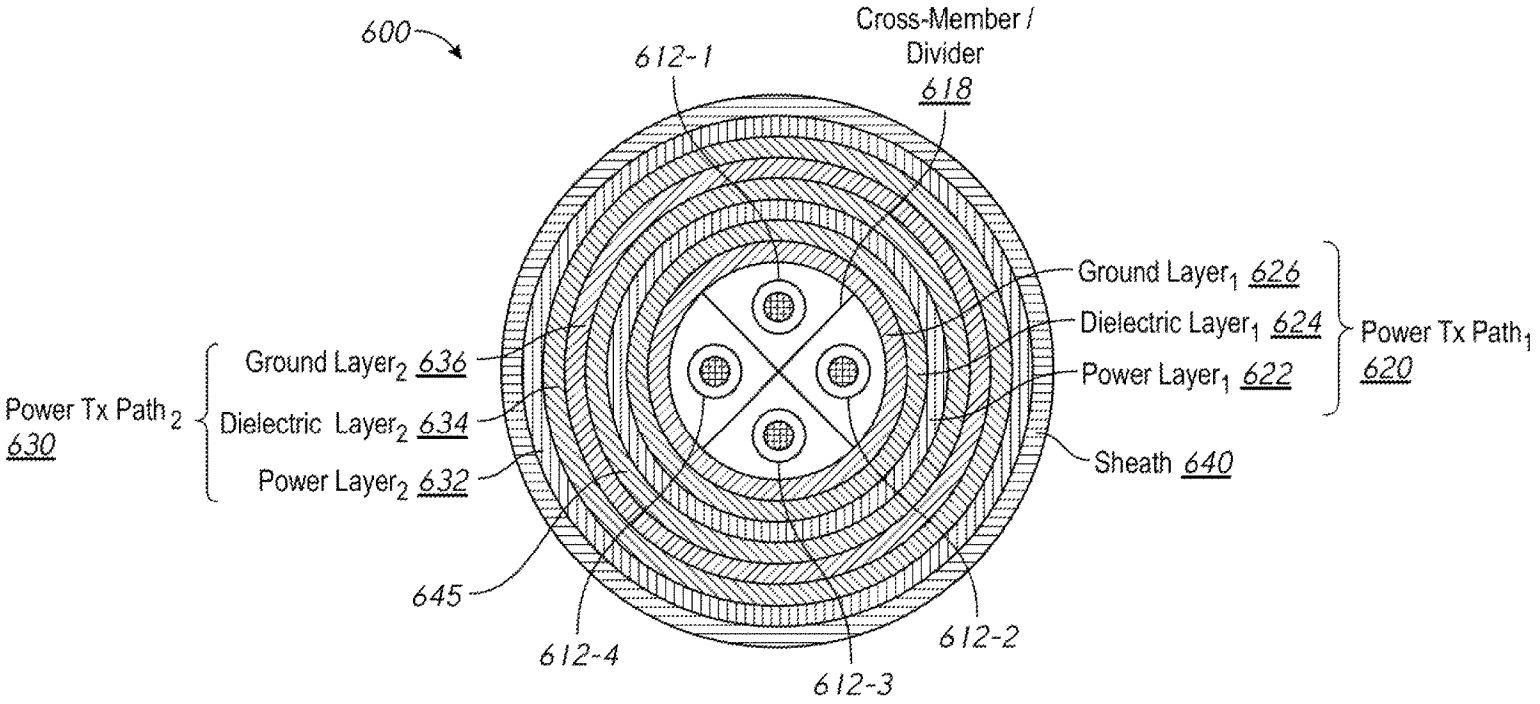
FIG. 6A is yet another cross-section view of a unified power and data cable in accordance with some implementations.

FIG. 6A is yet another cross-section view of a unified power and data cable 600 in accordance with some implementations. For example, the unified power and data cable 600 is one of the cables 220 in FIG. 2. In some implementations, the unified power and data cable 600 comprises: a data transmission path with a plurality of data lines 612; a first power transmission path 620 that sheathes the data transmission path; a second power transmission path 630 that sheathes the first power transmission path 620; and a sheath 640 that sheathes the second power transmission path 630.

In FIG. 6A, the data transmission path includes data lines 612-1, 612-2, 612-3, and 612-4 that extend along the longitudinal axis of the unified power and data cable 600. In some implementations, one of ordinary skill in the art will appreciate that the data transmission path comprises an arbitrary number of data lines. In some implementations, the data transmission path also includes a cross-member/divider 618 to shield and separate the plurality of data lines 612 as shown in FIG. 6A. In some implementations, the number of compartments forming and the geometry of the cross-member/divider 618 are determined by the number of data lines 612 in the data transmission path.

Similar to the power transmission path 320 in FIG. 3, the first power transmission path 620 comprises: a power layer 622; a dielectric layer 624; and a ground layer 626. Moreover, the second power transmission path 630 comprises: a power layer 632; a dielectric layer 634; and a ground layer 636. In some implementations, the aforementioned components of the first power transmission path 620 and the second power transmission path 630 are adapted from those discussed above with reference to the power transmission path 320 in FIG. 3 and are not described again in detail for the sake of brevity.

With reference to FIG. 6A, a dielectric layer 645 is located between the first power transmission path 620 and the second power transmission path 630. Although the unified power and data cable 600 includes two power transmission paths, one of ordinary skill in the art will appreciate that the unified power and data cable 600 comprises an arbitrary number of power transmission paths. As such, in some implementations, additional power transmission paths are added to the unified power and data cable for a modularly expansive current carrying capacity and a capacitance value that suits particular needs.

Figure 6B:
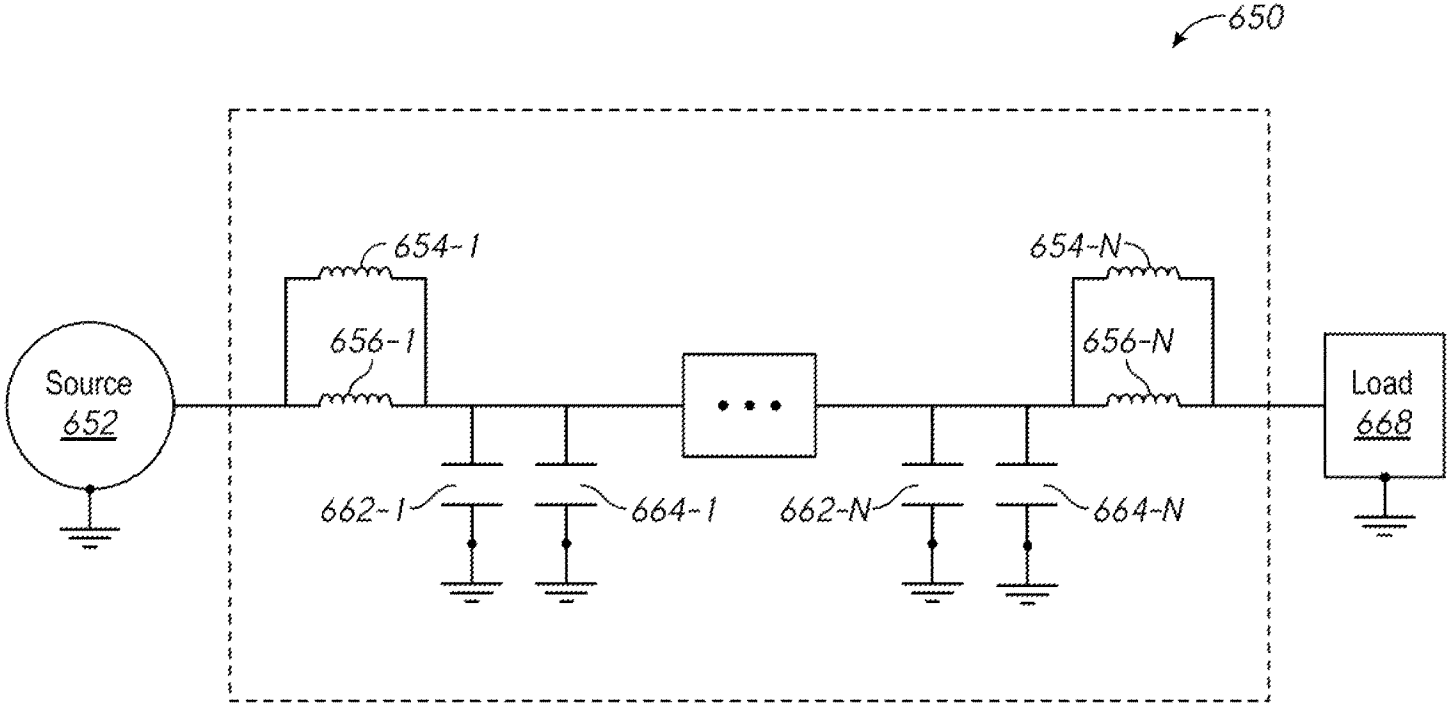
FIG. 6B is a schematic diagram of multiple power transmission lines connected in parallel with parasitics in accordance with some implementations.

FIG. 6B is a schematic diagram of multiple power transmission lines in connected parallel with parasitics corresponding to the unified power and data cable 600 in FIG. 6A in accordance with some implementations. In FIG. 6B, the source 652 (e.g., one of network switches 112 in FIG. 2) delivers power to a load 668 (e.g., a failed on of the network switches 112 in FIG. 2 and/or devices connected thereto) via the unified power and data cable 600 shown in FIG. 6A. In accordance with some implementations, the unified power and data cable 600 is modeled as block 650 of the schematic in FIG. 6B. Because the unified power and data cable 600 includes two power transmission paths, the block 650 includes a first plurality of inductors 654-1, . . . , 654-N connected in parallel with a second plurality of inductors 656-1, . . . , 656-N and also a first plurality of capacitors 662-1, . . . , 662-N connected in parallel with a second plurality of capacitors 664-1, . . . , 664-N. As a result of the electrical characteristics of inductors, the connection of the first and second plurality of inductors 654, 656 in parallel decreases the overall inductance of the unified power and data cable 600. And, due to the electrical characteristics of capacitors, the connection of the first and second plurality of capacitors 662, 664 in parallel increases the overall capacitance of the unified power and data cable 600.

While various aspects of implementations within the scope of the appended claims are described above, it should be apparent that the various features of implementations described above may be embodied in a wide variety of forms and that any specific structure and/or function described above is merely illustrative. Based on the present disclosure one skilled in the art should appreciate that an aspect described herein may be implemented independently of any other aspects and that two or more of these aspects may be combined in various ways. For example, an apparatus may be implemented and/or a method may be practiced using any number of the aspects set forth herein. In addition, such an apparatus may be implemented and/or such a method may be practiced using other structure and/or functionality in addition to or other than one or more of the aspects set forth herein.

It will also be understood that, although the terms "first," "second," etc. may be used herein to describe various elements, these elements should not be limited by these terms. These terms are only used to distinguish one element from another. For example, a first layer could be termed a second layer, and, similarly, a second layer could be termed a first layer, which changing the meaning of the description, so long as all occurrences of the "first layer" are renamed consistently and all occurrences of the "second layer" are renamed consistently. The first layer and the second layer are both layers, but they are not the same layer.

The terminology used herein is for the purpose of describing particular embodiments only and is not intended to be limiting of the claims. As used in the description of the embodiments and the appended claims, the singular forms "a", "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

What is claimed is:

1. A cable comprising:

a data transmission path disposed about an axial center of the cable, the data transmission path including:

a plurality of insulated conductive paths, wherein the plurality of insulated conductive paths extend along a longitudinal axis of the cable; and a divider that separates the plurality of insulated conductive paths from each other;

a power transmission path sheathing the data transmission path, wherein the power transmission path includes a power layer that is a solid conductor plane as a current source path, a ground layer that is a ground plane as a current return path for bidirectional power transmission, and a dielectric layer located between the power layer and the ground layer, wherein a capacitance value of the power transmission path satisfies a threshold capacitance value within a predefined tolerance range at frequencies above a first frequency level based on a function of (A) a thickness of the dielectric layer that is less than a predetermined thickness threshold and (B) a permittivity value corresponding to a material of the dielectric layer that meets a predetermined permittivity threshold;

a shield layer located between the data transmission path and the power transmission path; and a first connector terminating a first end of the cable and a second connector terminating a second end of the cable, wherein the first and the second connectors are configured to connect to first and second devices, respectively, for coupling the data transmission path between the first and the second devices for bidirectional data transmission and for coupling the power transmission path between the first and the second devices for redundant bidirectional power transmission.

2. The cable of claim 1, wherein the frequency dependent impedance characteristic of the power transmission path is characterized by an inductance value that satisfies a first inductance criterion at frequencies above a first frequency level.

3. The cable of claim 1, wherein the frequency dependent impedance characteristic of the power transmission path is characterized by an inductance value that satisfies a second inductance criterion at frequencies below a second frequency level.

4. The cable of claim 1, wherein the power layer sheathes the ground layer.

5. The cable of claim 1, wherein the power layer is the current source path for current delivered from a power source to a device, and wherein the ground layer is the current return path for the current.

6. The cable of claim 1, wherein the ground layer shields the data transmission path from electromagnetic interference.

7. The cable of claim 1, wherein the plurality of insulated conductive paths comprises a plurality of data lines.

8. The cable of claim 7, wherein the ground layer is a return path for the one or more data lines.

9. The cable of claim 1, wherein the power transmission path is radially disposed about the axial center of the cable.

10. The cable of claim 1, further comprising:

a second power transmission path sheathing the first power transmission path, the second power transmission path including a power layer and a ground layer, wherein the second power transmission path is characterized by a distributed impedance path having at least one frequency dependent impedance characteristic.

11. A system, comprising:

two or more devices; and a cable coupling the two or more devices, the cable comprising:

a data transmission path disposed about an axial center of the cable, the data transmission path including:

a plurality of insulated conductive paths, wherein the plurality of insulated conductive paths extend along a longitudinal axis of the cable; and a divider that separates the plurality of insulated conductive paths from each other;

a power transmission path sheathing the data transmission path, wherein the power transmission path includes a power layer that is a solid conductor plane as a current source path, a ground layer that is a ground plane as a current return path for bidirectional power transmission, and a dielectric layer located between the power layer and the ground layer, wherein a capacitance value of the power transmission path satisfies a threshold capacitance value within a predefined tolerance range at frequencies above a first frequency level based on a function of (A) a thickness of the dielectric layer that is less than a predetermined thickness threshold and (B) a permittivity value corresponding to a material of the dielectric layer that meets a predetermined permittivity threshold;

a shield layer located between the data transmission path and the power transmission path; and a first connector terminating a first end of the cable and a second connector terminating a second end of the cable, wherein the first and the second connectors are configured to connect to first and second devices, respectively, for coupling the data transmission path between the first and the second devices for bidirectional data transmission and for coupling the power transmission path between the first and the second devices for redundant bidirectional power transmission.

12. The system of claim 11, wherein the first device and the second device are networking switches.

13. An apparatus comprising:

a cable, including:

a data transmission path disposed about an axial center of the cable, the data transmission path including:

a plurality of insulated conductive paths, wherein the plurality of insulated conductive paths extend along a longitudinal axis of the cable; and a divider that separates the plurality of insulated conductive paths from each other;

a power transmission path sheathing the data transmission path, wherein the power transmission path includes a power layer that is a solid conductor plane as a current source path, a ground layer that is a ground plane as a current return path for bidirectional power transmission, and a dielectric layer located between the power layer and the ground layer, wherein a capacitance value of the power transmission path satisfies a threshold capacitance value within a predefined tolerance range at frequencies above a first frequency level based on a function of (A) a thickness of the dielectric layer that is less than a predetermined thickness threshold and (B) a permittivity value corresponding to a material of the dielectric layer that meets a predetermined permittivity threshold;

a shield layer located between the data transmission path and the power transmission path; and a first connector terminating a first end of the cable and a second connector terminating a second end of the cable, wherein the first and the second connectors are configured to connect to first and second devices, respectively, for coupling the data transmission path between the first and the second devices for bidirectional data transmission and for coupling the power transmission path between the first and the second devices for redundant bidirectional power transmission.

* * * * *